United States Patent [19]

Laing

[11] 4,131,157

[45] Dec. 26, 1978

[54] ROTARY HEAT EXCHANGERS

[76] Inventor: Nikolaus Laing, Hofener Weg 35 bis 37, 7141 Aldingen bei Stuttgart, Fed. Rep. of Germany

[21] Appl. No.: 751,193

[22] Filed: Dec. 16, 1976

Related U.S. Application Data

[62] Division of Ser. No. 566,533, Mar. 10, 1975, abandoned.

[30] Foreign Application Priority Data

Mar. 18, 1974 [AU] Australia ..... 2225/74

[51] Int. Cl.[2] ..... F28D 11/02

[52] U.S. Cl. ..... 165/86; 165/121; 62/499

[58] Field of Search ..... 62/325, 499; 165/86, 165/125, 151, 152; 415/54, 178, 183, 206

[56] References Cited

U.S. PATENT DOCUMENTS

| | | | |
|---|---|---|---|
| 1,403,319 | 1/1922 | Harter | 165/125 |
| 1,421,221 | 6/1922 | Harter | 165/125 |
| 1,619,776 | 3/1927 | Yates et al. | 165/125 |
| 2,512,540 | 6/1950 | Friedman | 165/146 |
| 2,991,982 | 7/1961 | Johnson | 415/178 X |
| 3,001,384 | 9/1961 | Hanson et al. | 62/499 |
| 3,035,760 | 5/1962 | Simmons | 165/122 |
| 3,347,059 | 10/1967 | Laing | 62/325 |
| 3,866,668 | 2/1975 | Doesner | 165/125 |

FOREIGN PATENT DOCUMENTS

| | | | |
|---|---|---|---|
| 255444 | 5/1972 | Fed. Rep. of Germany | 165/125 |

*Primary Examiner*—Charles J. Myhre
*Assistant Examiner*—Theophil W. Streule, Jr.
*Attorney, Agent, or Firm*—Pennie & Edmonds

[57] ABSTRACT

In a blower heat exchanger, (defined as a rotating heat exchanger without external means for fluid transport), several annular fin regions are provided, arranged in series in the radial direction which are staggered against each other, whereby the heat exchange is improved.

4 Claims, 5 Drawing Figures

1'
64
60
1
61
5
9
81
5
2
2'
22
8
-80-
3
5
3'
65'
65''
66
66
67

ROTARY HEAT EXCHANGERS

This is division of application Ser. No. 556,533, filed Mar. 10, 1975 now abandoned.

THE PRIOR ART

Blower heat exchangers with annular fins traversed by tubes are known. They continue to gain in importance because they perform two functions simultaneously, namely the transport of air and the transfer of heat. The moment exchange in rotary heat exchangers takes place, as a rule, by shear stresses, i.e. through friction and thus is due to the same phenomenon which is necessary to perform the heat exchange. In this way, the ratio of the mechanical power input to the transmitted thermal power is very favourable.

THE OBJECT OF THE INVENTION

The object of the invention is a rotating heat exchanger, the heat transfer coefficients of which are much larger than those in known rotating heat exchangers so that the amount of material which has to be deployed can be substantially reduced.

DESCRIPTION OF THE INVENTION

The invention relates to a blower heat exchanger having an annular finned body formed of annular fins arranged either axially alongside each other or helically and which are traversed by tubes in which a fluid heat carrier flows. The invention includes subdividing the finned body into at least two concentric annular regions in the radial direction which are separated from each other. In this way, each annular region is subject to a fresh approach flow which leads to enhanced heat exchange and thus to a reduction of the amount of material used.

A further improvement of the invention comprises inserting between radially succeeding annular regions, a deflecting blade ring which is rotatable with respect to the annular regions. In this way, the approach flow velocity is substantially increased in the second annular region and the heat exchanger is correspondingly further enhanced. Rings or coils can be substituted for the blades which have the same effect as the deflecting blades, with the difference, however, that they cause a smaller deflection of the flow.

A form of embodiment of a variant consists in that the annular body which performs the heat exchange is stationary, while a disc provided with deflecting blades rotates.

In one embodiment of the invention the annular fins are arranged relatively displaced in two annular regions one behind the other when viewed radially. This arrangement procures the advantage that both annular regions are arranged on a common axis and rotate together. This embodiment may be improved further by providing that the annular regions have a relative velocity with respect to each other.

The invention is explained with the help of figures.

FIG. 1 shows a partial longitudinal cross-section through one form of embodiment of a blower heat exchanger according to the invention.

FIG. 1*a* shows a similar form of embodiment as FIG. 1 with a stationary deflecting blade ring and a stationary annular finned region.

Figure 1:
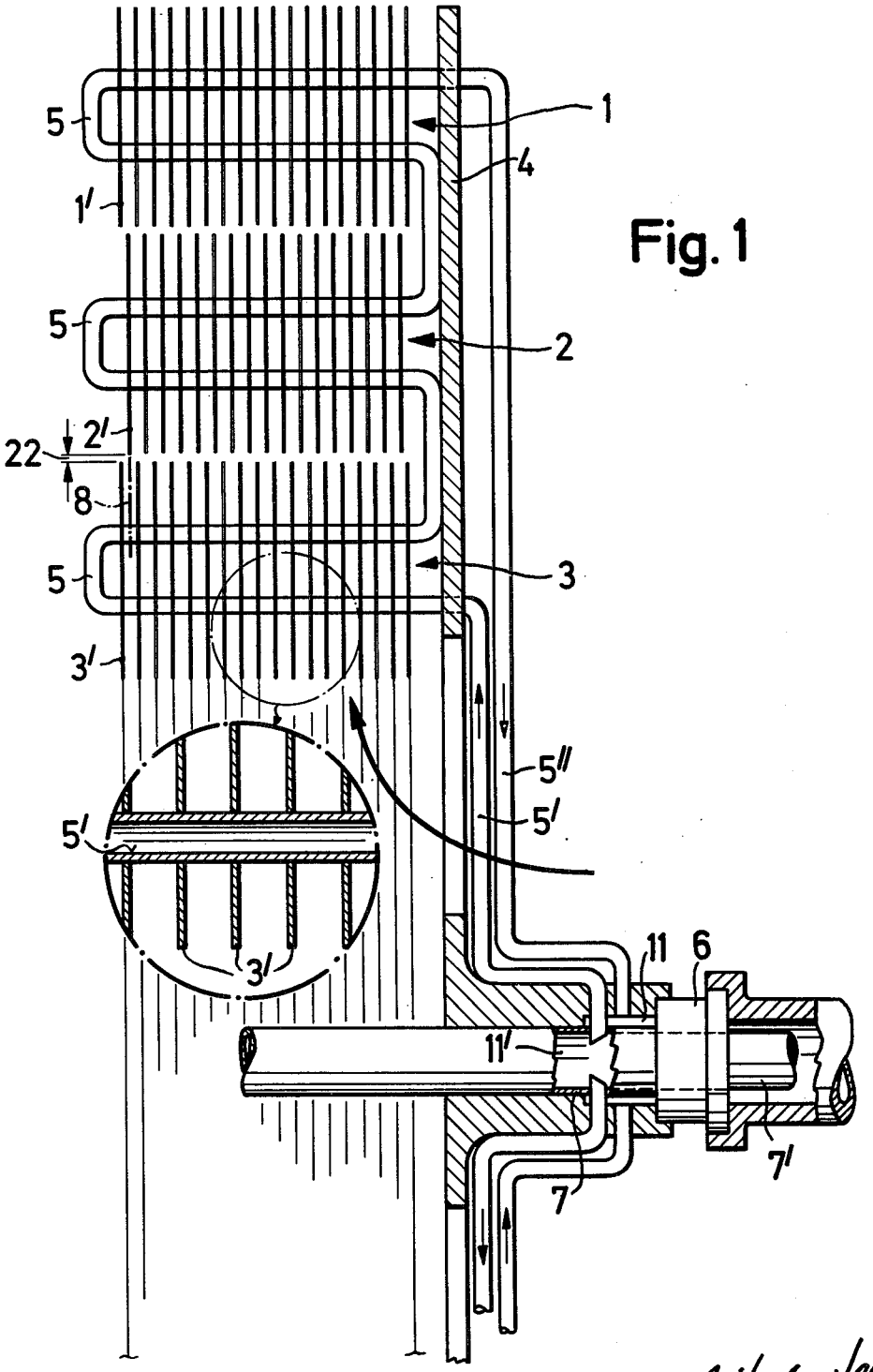

FIG. 1 shows a rotating blower heat exchanger having three radially spaced annular regions 1, 2 and 3 containing annular fins 1', 2' and 3' which are firmly attached to an annular disc 4 and which form a rotating unit with the disc. As shown the disc 4 is fixedly mounted on a rotatable shaft. The tubes 5 traverse the annular fins 1', 2', 3' in opposite directions and, in the example of the embodiment as shown, are connected in series so that the beginning 5' and the end 5'' of the tubes form a tube system which is connected to separate regions 11 which are and 11' tightly sealed from each other by means of a shaft seal 6. The annular space or distance 22 between the succeeding annular regions 1, 2, 3 can be made very small and preferably, the fins 1', 2' and 3' are axially staggered against each other in such a way that the fin 2' is situated in the centre plane 8 between neighbouring fins 3'.

Figure 1A:
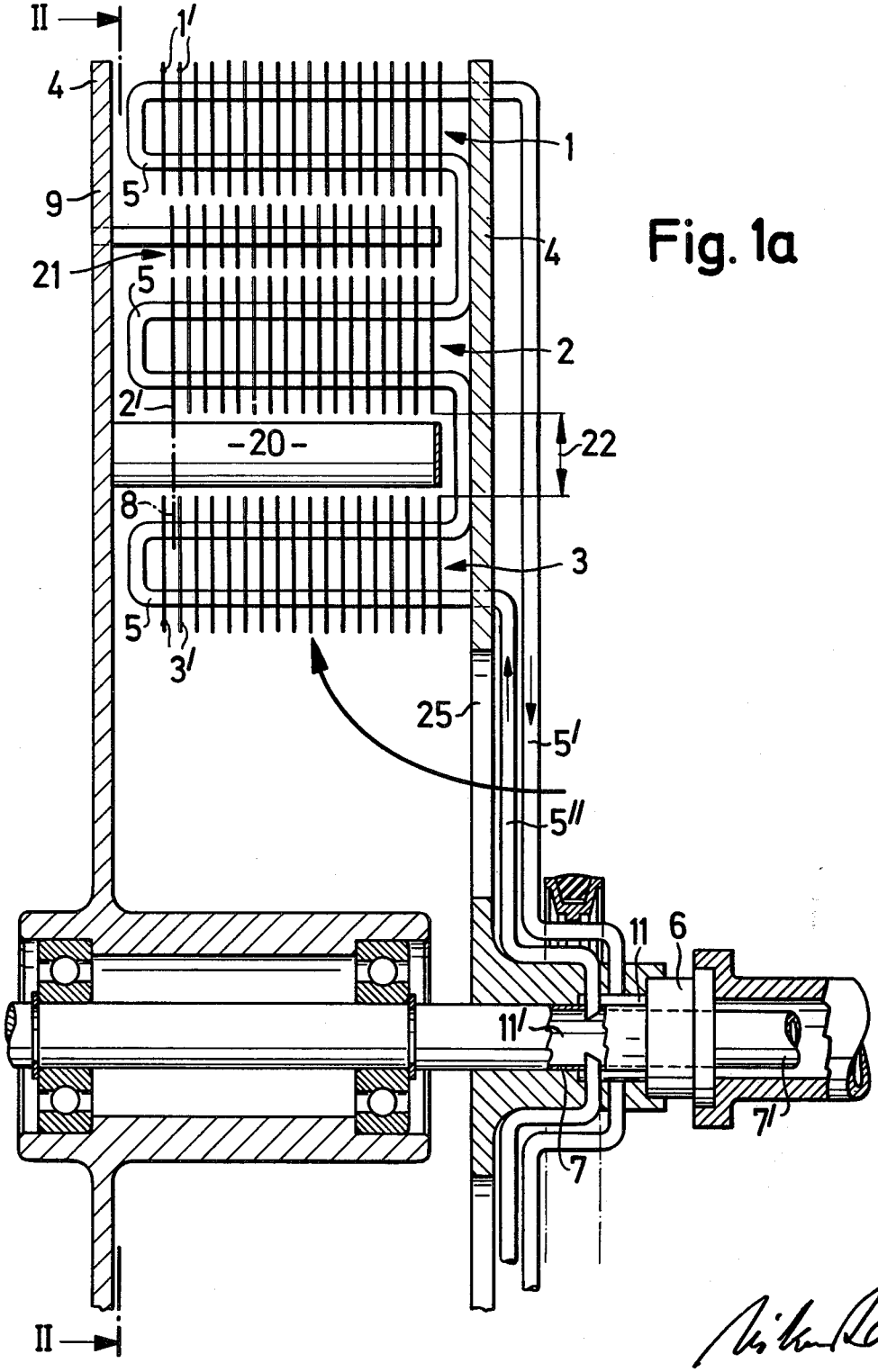

The form of embodiment shown in FIG. 1*a*, has a disc 4 and achieves an improved performance with the help of stationary deflecting blades 20 forming a blade ring and/or stationary rings or helical coils 21 inserted between the annular regions 1, 2 and 3 and mounted on a nonrotatable disc 9. Although these additional means require a larger distance 22 between succeeding fins 2' and 3' they provide a substantial improvement in the heat transfer coefficients. The radial extent of the rings 21 can be very small, one-tenth compared with the radial extent of the annular regions 1, 2 and 3.

Figure 2:
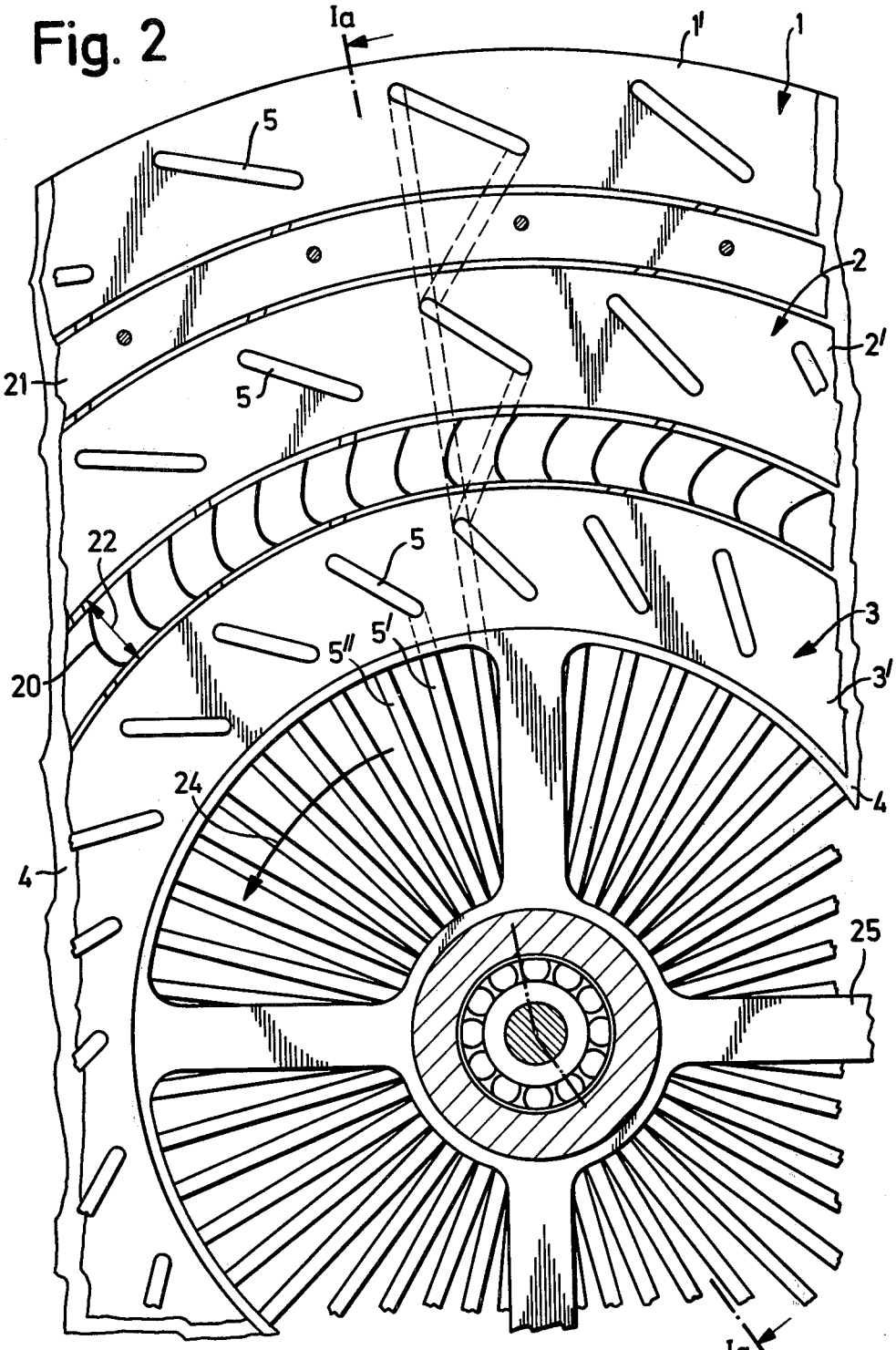
FIG. 2 shows a cross-section along the line II—II in FIG. 1*a*.

FIG. 2 shows a cross-section along the section plane II—II of FIG. 1a, but only through one circumferential segment of the half-section shown in FIG. 1a. This figure also shows the rotation directional arrow 24 and the spokes 25, between which the air enters. In one form of embodiment, either stationary deflecting blades only 20 or stationary annular fins 21 only may be provided.

Figure 3:
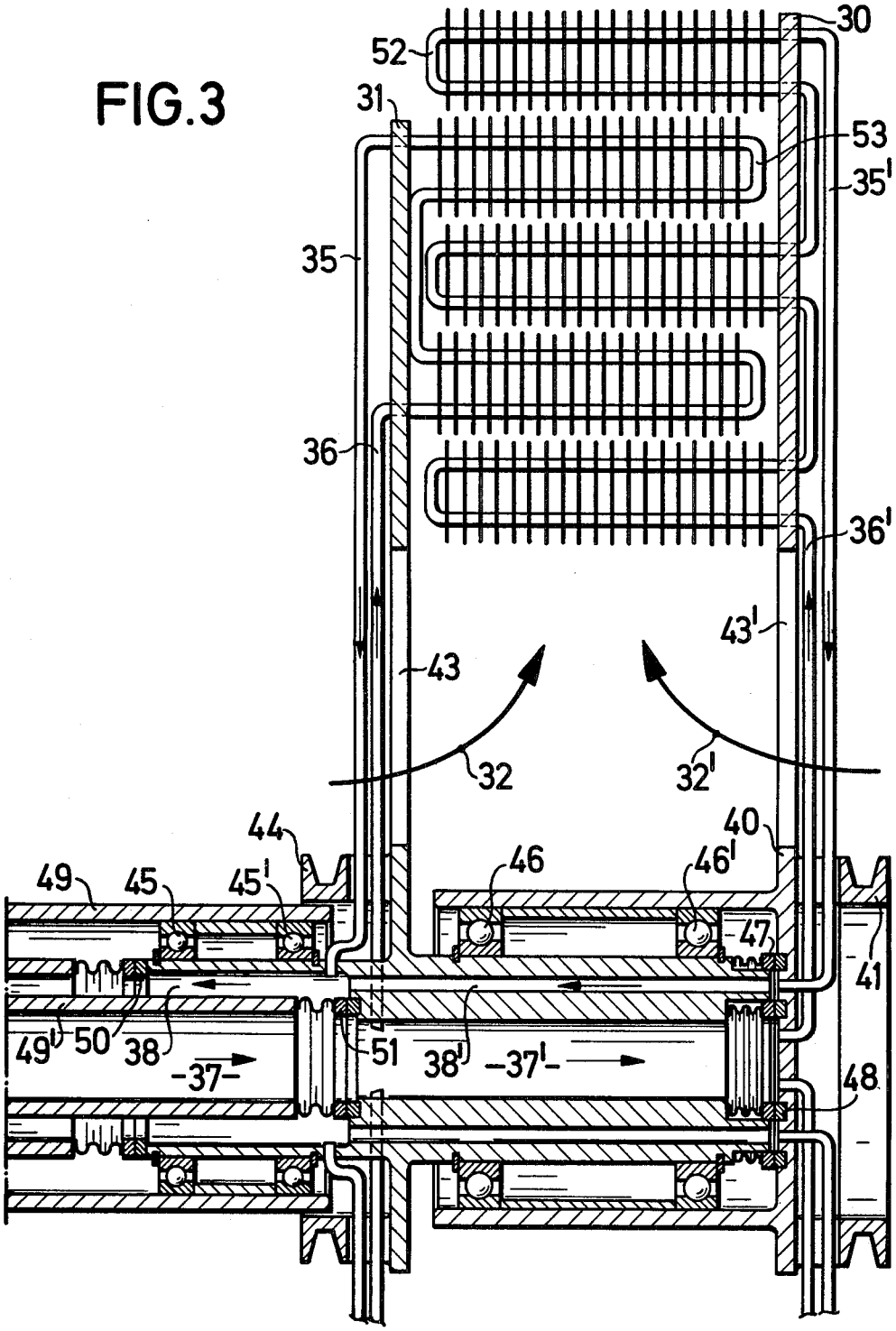
FIGS. 3 and 4 show two partial longitudinal cross-sections through two further forms of embodiment according to the invention.

FIG. 3 shows a heat exchanger according to the invention in which the first and second discs 30 and 31 are driven in opposite directions.

A shown each of the discs has a plurality of axially spaced annular fins mounted thereon to form annular regions with two regions of different diameters being connected with the second disc and two regions of different diameters being connected to the first disc and whereby the annular regions associated with the second disc extend into the radial spaces between the annular regions associated with the first disc. This arrangement ensures that all the surfaces in contact with the air flowing in directions 32 and 32' are heat exchange surfaces at the same time. The tubes 35 and 36 mounted on rotor 31 communicate with ducts 38 and 38 situated in the hub region while tubes 35' and 36' mounted on disc 30 communicate with ducts 38' and 37'. The disc 30 is attached to the hub by spokes 43' such that the drive takes place via the V-belt pulley 41. The disc 31 is attached to the V-belt pulley 44 by spokes 43. The two discs are carried in bearings 45 and 45' and are simultaneously supported against each other in bearings 46 and 46'. The ducts 38 and 38' communicate with each other as do the tubes 35 and 35' as well as the tubes 36 and 36'. Two axial shaft seals 47 and 48 are situated between the rotating discs 30 and 31, whilst the stationary tubular components 49 and 49' are sealed against the rotating system of the disc 31 by the shaft seals 50 and 51. The heat carrier tubes 52 and 53 are shaped as in FIG. 1, in hair pin fashion but are shown here in broken lines only. As shown the annular fins on discs 30 and 31 form a plurality of annular regions similar to regions 1, 2 and 3 of FIG. 1 where some of the annular regions of one disc extend into the annular space between the annular regions of the other disc.

Figure 4:
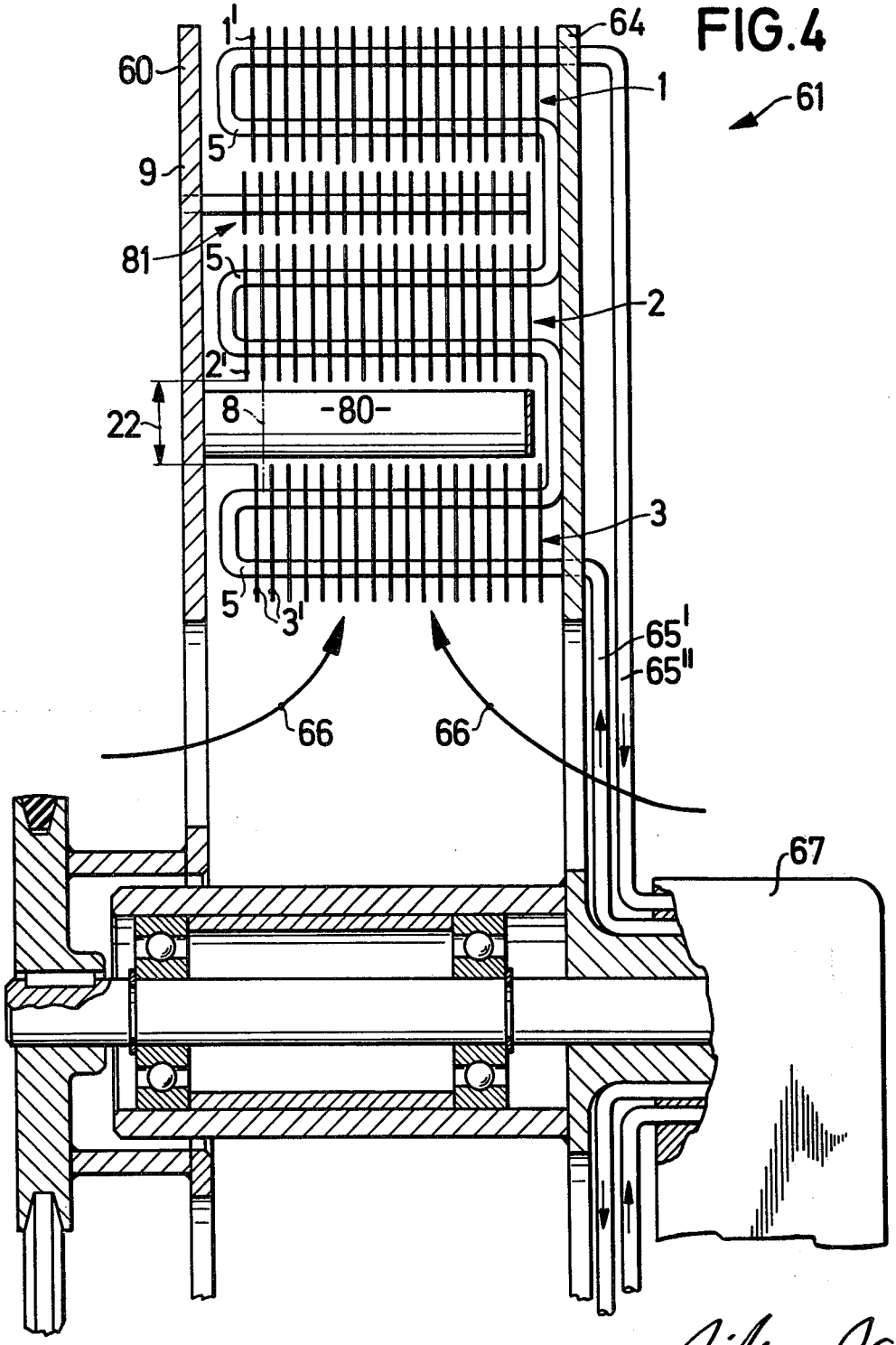

FIG. 4 shows the inverse arrangement of the heat exchanger according to FIG. 1a where the disc 60 is rotatable and the disc 64 is non-rotatable. Deflecting blades 80 which are similar to blades 20 shown in FIG. 1a, can be provided or else as an alternative, rings 81 similar to rings 21 of FIG. 1a can be arranged axially alongside each other. The non-rotatable heat exchanger 61 is constructed substantially like the heat exchanger 4 in FIG. 1. It contains a disc 64, tubes 65', and 65" and also wall apertures which permit the through flow of the air 66 but is arranged to be non-rotatably, fixed to the support 67. Beyond this, the same explanation is applicable as that given in relation to FIGS. 1 and 1a.

I claim:

1. Blower heat exchanger comprising first and second rotatable annular discs co-axially mounted with respect to each other, a plurality of axially spaced annular fins of a first diameter mounted on said first rotatable annular disc to form a first annular region and a plurality of axially spaced annular fins of a second diameter greater than said first diameter mounted on said first rotatable annular disc to form a second annular region radially spaced from said first annular region, a plurality of axially spaced fins of a diameter intermediate said first and second diameter mounted on the second rotatable disc to form a third annular region extending into the radial space between said first and second annular regions, and axially extending heat exchanger tubes connecting the axially spaced annular fins of each annular region with the tubes of the annular regions associated with each disc being interconnected to form a tube system associated with that disc.

2. Blower heat exchanger according to claim 1 wherein the axially spaced annular fins of one region are staggered with the axially extending fins of a radially adjacent annular region.

3. Blower heat exchanger according to claim 1 wherein said first and second discs are rotatable in opposite directions.

4. Blower heat exchanger according to claim 1 wherein said first disc has in addition a plurality of axially spaced fins of greater diameter than said second diameter to form a third annular region radially spaced from said second annular region and said second disc has in addition a further plurality of annular extending discs of a diameter greater than said intermediate diameter to form a further annular region of greater diameter than said intermediate annular region and to extend between said second and third annular regions.

* * * * *